US008076849B2

(12) United States Patent
Ryu et al.

(10) Patent No.: US 8,076,849 B2
(45) Date of Patent: Dec. 13, 2011

(54) PLASMA DISPLAY PANEL HAVING A BUS ELECTRODE

(75) Inventors: Seongnam Ryu, Gumi (KR); Woogon Jeon, Gumi (KR); Wootae Kim, Gumi (KR); Kyunga Kang, Gumi (KR); Jeonghyun Hahm, Gumi (KR); Jaesung Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 339 days.

(21) Appl. No.: 11/923,206

(22) Filed: Oct. 24, 2007

(65) Prior Publication Data

US 2008/0100218 A1 May 1, 2008

(30) Foreign Application Priority Data

Oct. 26, 2006 (KR) ..... 10-2006-0104715

(51) Int. Cl.
*H01J 17/26* (2006.01)
*H01J 17/49* (2006.01)

(52) U.S. Cl. ..... 313/582; 313/567; 313/583; 313/584; 313/585

(58) Field of Classification Search ..... None
See application file for complete search history.

(56) References Cited

U.S. PATENT DOCUMENTS 6,512,237 B2 * 1/2003 Nakasugi et al. ..... 250/491.1
6,670,754 B1 * 12/2003 Murai et al. ..... 313/582
7,009,587 B2 3/2006 Nishimura
7,714,510 B2 * 5/2010 Ryu et al. ..... 313/586
2002/0047591 A1 4/2002 Hirano et al.
2006/0232210 A1 * 10/2006 Kim ..... 313/582
2007/0029908 A1 * 2/2007 Goto et al. ..... 313/306

FOREIGN PATENT DOCUMENTS

CN 1787051 A 6/2006
CN 1841627 A 10/2006
EP 1 659 558 A2 5/2006
JP 2006-286630 10/2006
KR 10-2003-0024887 A 3/2003
KR 10-2006-0065120 A 6/2006
WO WO 2005043577 A1 * 5/2005

OTHER PUBLICATIONS

International Search Report and Written Opinion for Application No. PCT/KR2007/005264, dated Jan. 30, 2008, 16 pages.
Office Action, issued by Chinese Patent Office dated Jul. 17, 2009 for Application No. 200780001418.2, full English translation, 9 pages.
Office Action, issued by Korean Patent Office dated Sep. 18, 2007 for Application No. 10-2006-0104715, not translated, 5 pages.
European Search Report dated Aug. 6, 2010 for Application No. 07833573.4, 9 pages.

* cited by examiner

*Primary Examiner* — Natalie Walford
(74) *Attorney, Agent, or Firm* — Fish & Richardson P.C.

(57) ABSTRACT

A plasma display panel is disclosed. The plasma display panel includes a front substrate on which first and second electrodes are positioned parallel to each other, a rear substrate on which a third electrode is positioned to intersect the first and second electrodes, and a barrier rib positioned between the front and rear substrates to partition a discharge cell. At least one of the first or second electrode has a single-layered structure. At least one of the first or second electrode includes a plurality of line portions intersecting the third electrode, a projecting portion projecting from the line portion, and a connecting portion connecting at least two line portions to each other. The projecting portion and the connecting portion are positioned in a straight line.

13 Claims, 15 Drawing Sheets

PLASMA DISPLAY PANEL HAVING A BUS ELECTRODE

This application claims the benefit of Korean Patent Application No. 10-2006-0104715 filed on Oct. 26, 2006, which is hereby incorporated by reference.

BACKGROUND OF THE DISCLOSURE

1. Field of the Disclosure

This document relates to a plasma display panel.

2. Description of the Related Art

A plasma display panel includes phosphor layers inside discharge cells partitioned by barrier ribs and a plurality of electrodes. Driving signals are supplied to the discharge cells through the electrodes.

When the driving signal generates a discharge inside the discharge cells, a discharge gas filled in the discharge cells generates vacuum ultraviolet rays, which thereby cause phosphors formed inside the discharge cells to emit light, thus displaying an image on the screen of the plasma display panel.

SUMMARY OF THE DISCLOSURE

In one aspect, a plasma display panel comprises a front substrate on which a first electrode and a second electrode are positioned parallel to each other, a rear substrate on which a third electrode is positioned to intersect the first electrode and the second electrode, and a barrier rib positioned between the front substrate and the rear substrate to partition a discharge cell, wherein at least one of the first electrode or the second electrode has a single-layered structure, at least one of the first electrode or the second electrode includes a plurality of line portions intersecting the third electrode, a projecting portion projecting from the line portion, and a connecting portion connecting at least two line portions of the plurality of line portions to each other, and the projecting portion and the connecting portion are positioned in a straight line.

In another aspect, a plasma display panel comprises a front substrate on which a first electrode and a second electrode are positioned parallel to each other, a rear substrate on which a third electrode is positioned to intersect the first electrode and the second electrode, and a barrier rib positioned between the front substrate and the rear substrate to partition a discharge cell, wherein at least one of the first electrode or the second electrode has a single-layered structure, at least one of the first electrode or the second electrode includes a plurality of line portions intersecting the third electrode, a plurality of projecting portions projecting from the line portion, and a plurality of connecting portions connecting at least two line portions of the plurality of line portions to each other, the projecting portion and the connecting portion are positioned in a straight line, and an interval between two successively positioned line portions of the plurality of line portions is larger than an interval between two successively positioned connecting portions of the plurality of connecting portions.

In still another aspect, a plasma display panel comprises a front substrate on which a first electrode and a second electrode are positioned parallel to each other, a rear substrate on which a third electrode is positioned to intersect the first electrode and the second electrode, and a barrier rib positioned between the front substrate and the rear substrate to partition a discharge cell, wherein at least one of the first electrode or the second electrode has a single-layered structure, at least one of the first electrode or the second electrode includes a plurality of line portions intersecting the third electrode, a projecting portion projecting from the line portion, and a connecting portion connecting at least two line portions of the plurality of line portions to each other, the projecting portion and the connecting portion are positioned in a straight line, and a first signal with a gradually falling voltage is supplied to the first electrode and a second signal of a polarity direction opposite a polarity direction of the first signal is supplied to the second electrode during a pre-reset period prior to a reset period of at least one subfield of a frame.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

FIGS. 1A to 1D illustrate an example of a structure of a plasma display panel according to an exemplary embodiment.

Figure 1A:
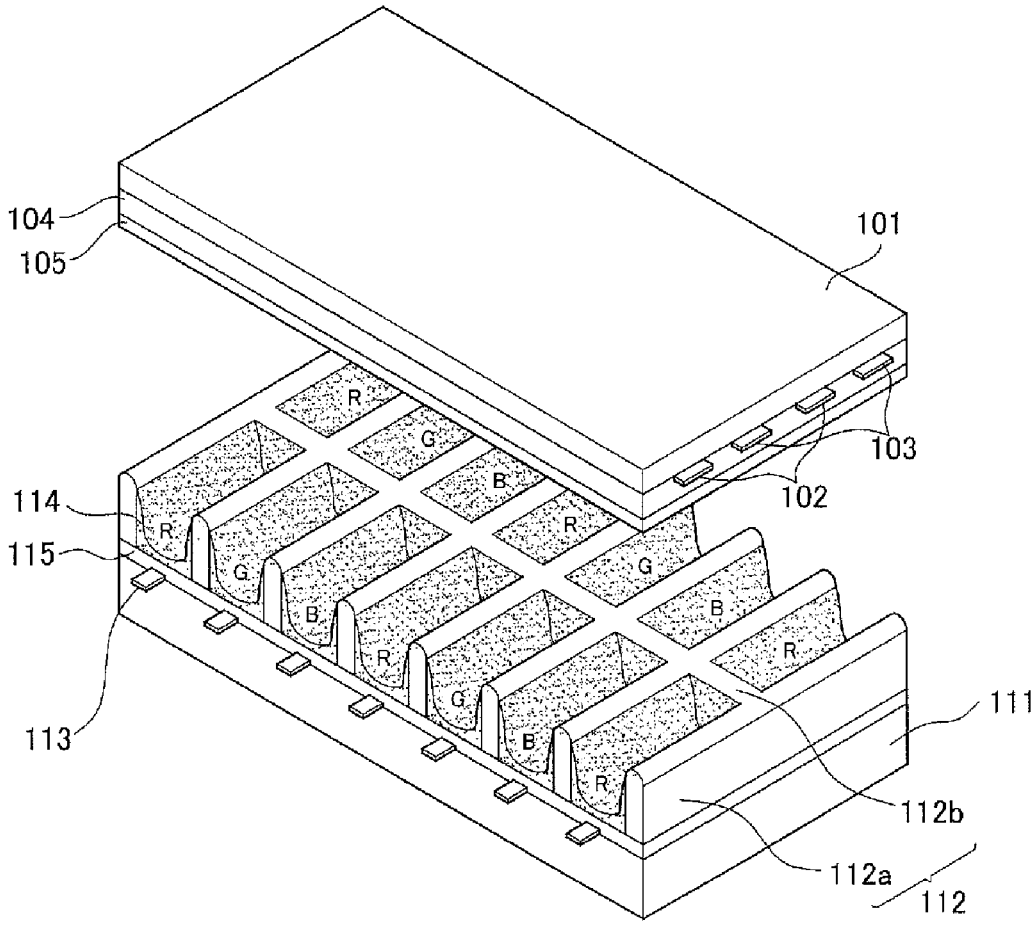
FIGS. 1A to 1D illustrate an example of a structure of a plasma display panel according to an exemplary embodiment.

As illustrated in FIG. 1A, the plasma display panel according to one embodiment includes a front substrate 101 and a rear substrate 111 which coalesce each other. On the front substrate 101, a first electrode 102 and a second electrode 103 are positioned in parallel to each other. On the rear substrate 111, a third electrode 113 is positioned to intersect the first electrode 102 and the second electrode 103.

At least one of the first electrode 102 or the second electrode 103 has a single-layered structure. For instance, at least one of the first electrode 102 or the second electrode 103 may be a bus electrode or ITO (indium-tin-oxide)-less electrode in which a transparent electrode is omitted.

At least one of the first electrode 102 or the second electrode 103 includes an opaque metal with excellent electrical conductivity. Examples of the opaque metal with excellent electrical conductivity include silver (Ag), copper (Cu), and aluminum (Al) that are cheaper than ITO.

The first electrode 102 and the second electrode 103 generate a discharge inside discharge spaces (i.e., discharge cells) and maintain the discharge of the discharge cells.

An upper dielectric layer 104 for covering the first electrode 102 and the second electrode 103 is positioned on the front substrate 101 on which the first electrode 102 and the second electrode 103 are positioned. The upper dielectric layer 104 limits discharge currents of the first electrode 102 and the second electrode 103 and provides insulation between the first electrode 102 and the second electrode 103.

A protective layer 105 is positioned on the upper dielectric layer 104 to facilitate discharge conditions. The protective layer 105 may be formed by deposition a material such as magnesium oxide (MgO) on the upper dielectric layer 104.

A lower dielectric layer 115 for covering the third electrode 113 is positioned on the rear substrate 111 on which the third electrode 113 is positioned. The lower dielectric layer 115 provides insulation of the third electrode 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell and a blue (B) discharge cell, and the like, are positioned between the front substrate 101 and the rear substrate 111.

In addition to the red (R), green (G), and blue (B) discharge cells, a white discharge cell or a yellow discharge cell may be further positioned between the front substrate 101 and the rear substrate 111.

The widths of the red (R), green (G), and blue (B) discharge cells may be substantially equal to one another. Further, the width of at least one of the red (R), green (G), or blue (B) discharge cells may be different from the widths of the other discharge cells.

Figure 1B:
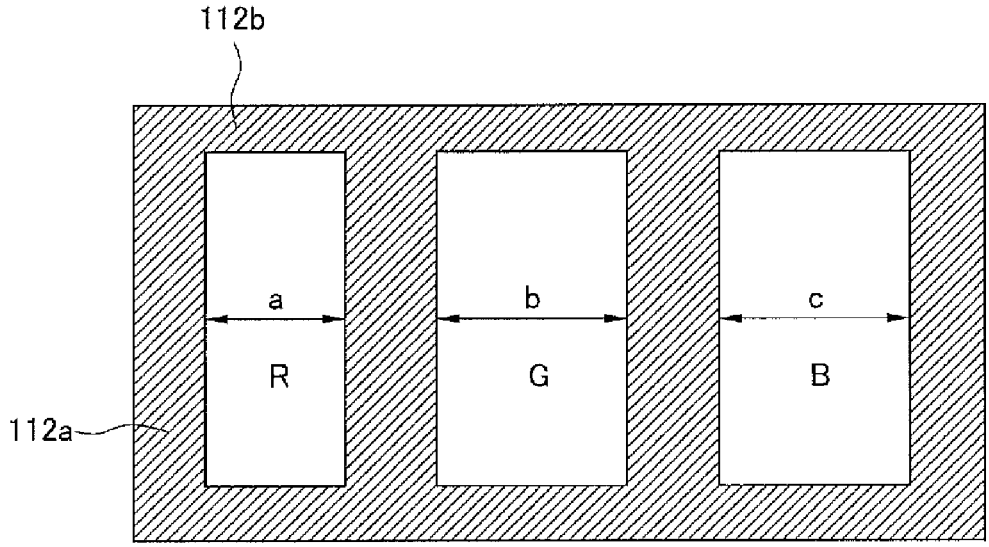

For instance, as illustrated in FIG. 1B, a width (a) of the red (R) discharge cell is the smallest, and widths (b and c) of the green (G) and blue (B) discharge cells are more than the width (a) of the red (R) discharge cell. The width (b) of the green (G) discharge cell may be substantially equal to or different from the width (c) of the blue (B) discharge cell.

The widths of the above-described discharge cells determine the width of a phosphor layer 114 formed inside the discharge cells, which will be described later. For instance, in a case of FIG. 1B, the width of a blue (B) phosphor layer formed inside the blue (B) discharge cell is more than the width of a red (R) phosphor layer formed inside the red (R) discharge cell. Further, the width of a green (G) phosphor layer formed inside the green (G) discharge cell is more than the width of a red (R) phosphor layer formed inside the red (R) discharge cell. Hence, a color temperature of an image displayed on the plasma display panel can be improved.

The plasma display panel according one embodiment may have various forms of barrier rib structures as well as a structure of the barrier rib 112 illustrated in FIG. 1A. For instance, the barrier rib 112 may include a first barrier rib 112*b* and a second barrier rib 112*a*. The barrier rib 112 may have a differential type barrier rib structure in which the height of the first barrier rib 112*b* and the height of the second barrier rib 112*a* are different from each other, a channel type barrier rib structure in which a channel usable as an exhaust path is formed on at least one of the first barrier rib 112*b* or the second barrier rib 112*a*, a hollow type barrier rib structure in which a hollow is formed on at least one of the first barrier rib 112*b* or the second barrier rib 112*a*, and the like.

Figure 1C:
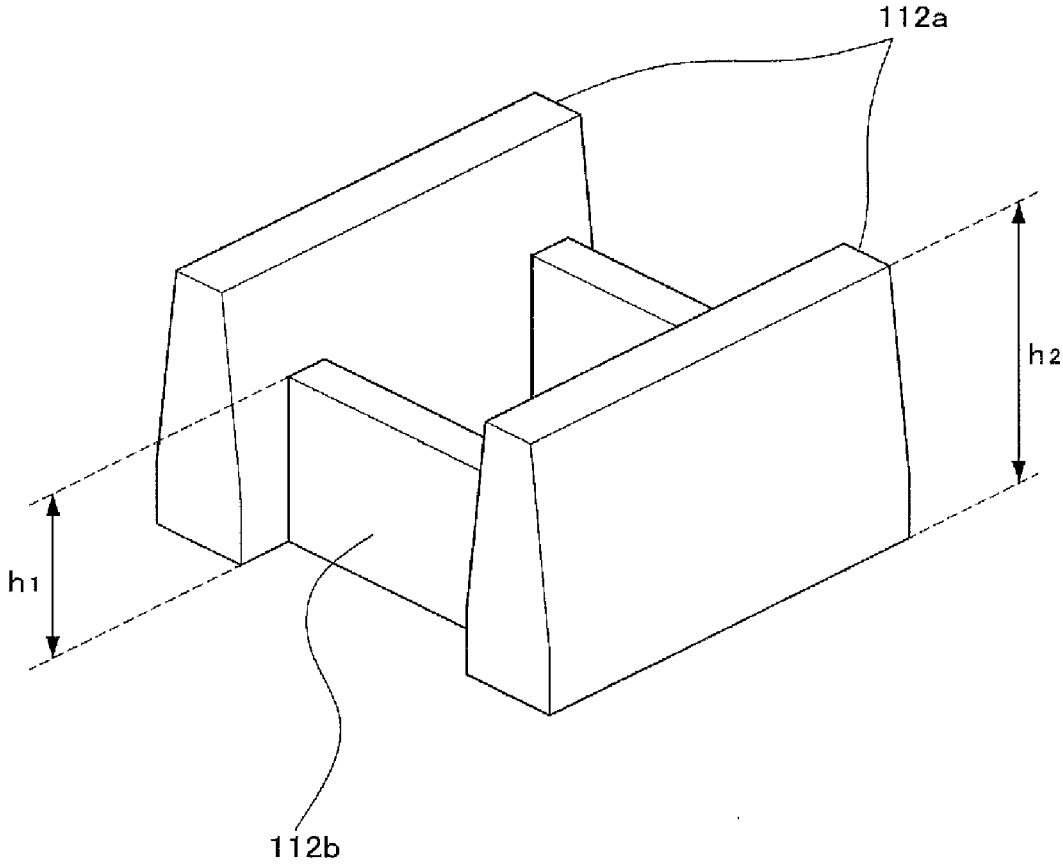

In the differential type barrier rib structure, as illustrated in FIG. 1C, a height h1 of the first barrier rib 112*b* is less than a height h2 of the second barrier rib 112*a*. Further, in the channel type barrier rib structure or the hollow type barrier rib structure, a channel or a hollow may be formed on the first barrier rib 112*b*.

While the plasma display panel according to one embodiment has been illustrated and described to have the red (R), green (G), and blue (B) discharge cells arranged on the same line, it is possible to arrange them in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1A has illustrated and described a case where the barrier rib 112 is formed on the rear substrate 111, the barrier rib 112 may be formed on at least one of the front substrate 101 or the rear substrate 111.

Each of the discharge cells partitioned by the barrier ribs 112 is filled with a predetermined discharge gas.

The phosphor layers 114 for emitting visible light for an image display during the generation of an address discharge are positioned inside the discharge cells partitioned by the barrier ribs 112. For instance, red (R), green (G) and blue (B) phosphor layers may be positioned inside the discharge cells.

A white phosphor layer and/or a yellow phosphor layer may be further positioned in addition to the red (R), green (G) and blue (B) phosphor layers.

Figure 1D:
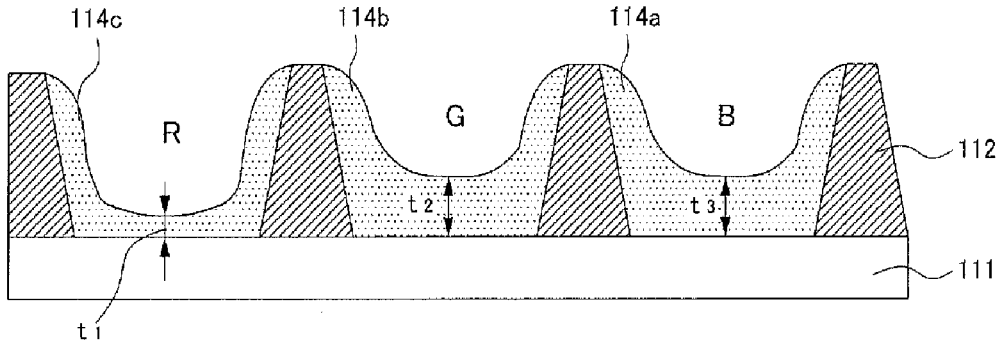

A thickness of at least one of the phosphor layers 114 formed inside the red (R), green (G) and blue (B) discharge cells may be different from thicknesses of the other phosphor layers. For instance, as illustrated in FIG. 1D, thicknesses t2 and t3 of phosphor layers 114*b* and 114*a* inside the green (G) and blue (B) discharge cells are larger than a thickness t1 of a phosphor layer 114*c* inside the red (R) discharge cell. The thickness t2 of the phosphor layer 114*b* inside the green (G) discharge cell may be substantially equal to or different from the thickness t3 of the phosphor layer 114*a* inside the blue (B) discharge cell.

In FIG. 1A, the upper dielectric layer 104 and the lower dielectric layer 115 each have a single-layered structure. However, at least one of the upper dielectric layer 104 or the lower dielectric layer 115 may have a multi-layered structure.

A black layer (not shown) for absorbing external light may be further positioned on the barrier rib 112 to prevent the reflection of the external light caused by the barrier rib 112.

Further, another black layer (not shown) may be further positioned at a specific position of the front substrate 101 corresponding to the barrier rib 112.

The third electrode 113 positioned on the rear substrate 11 may have a substantially constant width or thickness. Further, a width or thickness of the third electrode 113 inside the discharge cell may be different from a width or thickness of the third electrode 113 outside the discharge cell. For instance, a width or thickness of the third electrode 113 inside the discharge cell may be larger than a width or thickness of the third electrode 113 outside the discharge cell.

Figure 2:
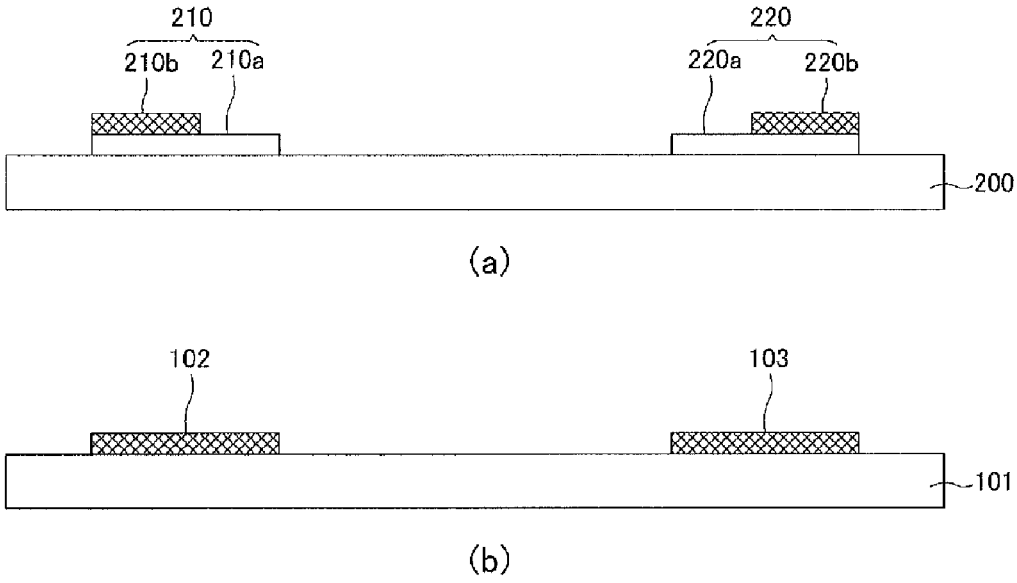
FIG. 2 illustrates a reason why at least one of a first electrode or a second electrode has a single-layered structure.

FIG. 2 illustrates a reason why at least one of a first electrode or a second electrode has a single-layered structure.

As illustrated in (a) of FIG. 2, unlike the exemplary embodiment, a first electrode 210 and a second electrode 220 each have a multi-layered structure on a front substrate 200.

For instance, the first electrode 210 and the second electrode 220 each include transparent electrodes 210*a* and 220*a* and bus electrodes 210*b* and 220*b*.

The transparent electrodes 210*a* and 220*a* may include a transparent material such as ITO. The bus electrodes 210*b* and 220*b* may include a metal material such as silver (Ag).

The transparent electrodes 210*a* and 220*a* are formed and then the bus electrodes 210*b* and 220*b* are formed to complete the first electrode 210 and the second electrode 220.

As illustrated in (b) of FIG. 2, the first electrode 102 and the second electrode 103 according to the exemplary embodiment each have a single-layered structure. For instance, at least one of the first electrode 102 or the second electrode 103 may be an ITO-less electrode in which a transparent electrode is omitted.

At least one of the first electrode 102 or the second electrode 103 may include a substantially opaque metal material with excellent electrical conductivity. Examples of the opaque metal with excellent electrical conductivity include silver (Ag), copper (Cu) and aluminum (Al) that are cheaper than ITO. At least one of the first electrode 102 or the second electrode 103 may further include a black material such as carbon (C), cobalt (Co) or ruthenium (Ru).

A process for forming the transparent electrodes 210*a* and 220*a* and a process for forming the bus electrodes 210*b* and 220*b* are required in (a) of FIG. 2. However, because a process for forming the transparent electrode is omitted in (b) of FIG. 2, the manufacturing cost can be reduced.

Further, because an expensive material such as ITO is not used in (b) of FIG. 2, the manufacturing cost can be further reduced.

Figure 3:
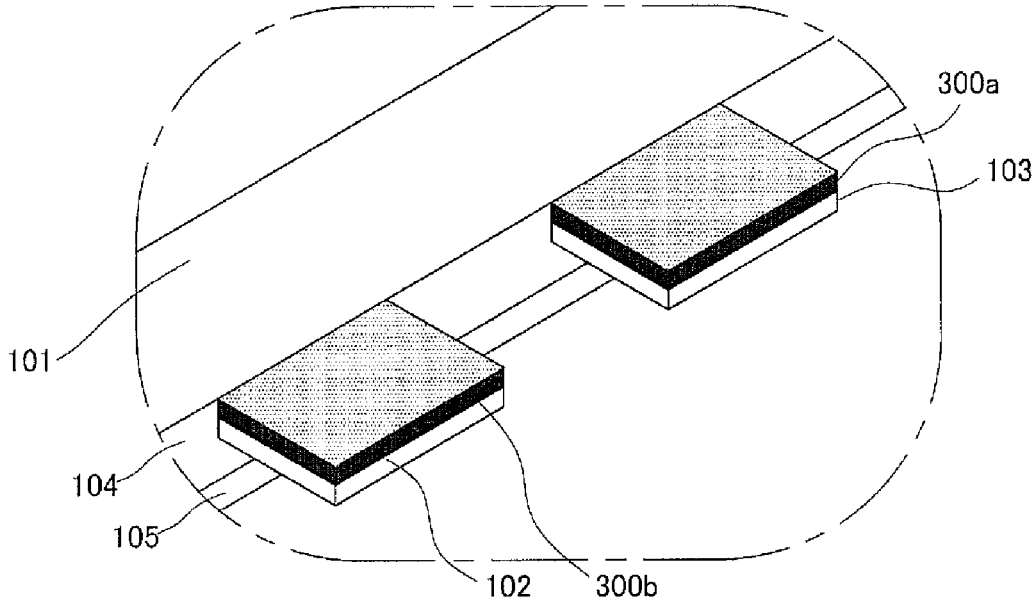
FIG. 3 illustrates an example of a structure in which a black layer is added between first and second electrodes and a front substrate.

FIG. 3 illustrates an example of a structure in which a black layer is added between first and second electrodes and a front substrate.

As illustrated in FIG. 3, black layers 300*a* and 300*b* are positioned between the front substrate 101 and at least one of the first or second electrode 102 or 103, thereby preventing discoloration of the front substrate 101. A degree of blackness of the black layers 300*a* and 300*b* is higher than a degree of blackness of at least one of the first or second electrode 102 or 103.

For instance, when the front substrate 101 directly contacts the first or second electrode 102 or 103, a predetermined area of the front substrate 101 directly contacting the first or second electrode 102 or 103 may change into a yellow-based color. The change of color is called a migration phenomenon. The black layers 300*a* and 300*b* prevent the migration phenomenon by preventing the direct contact of the front substrate 101 with the first or second electrode 102 or 103.

The black layers 300*a* and 300*b* may include a black material of a dark color, for example, ruthenium (Ru).

Since the black layers 300*a* and 300*b* are positioned between the front substrate 101 and the second electrode 103 and between the front substrate 101 and the first electrode 102, respectively, the generation of reflection light can be prevented even if the first and second electrodes 102 and 103 are formed of a material with a high reflectivity.

FIGS. 4A to 4D illustrate a first implementation associated with first and second electrodes of the plasma display panel according to the exemplary embodiment.

Figure 4A:
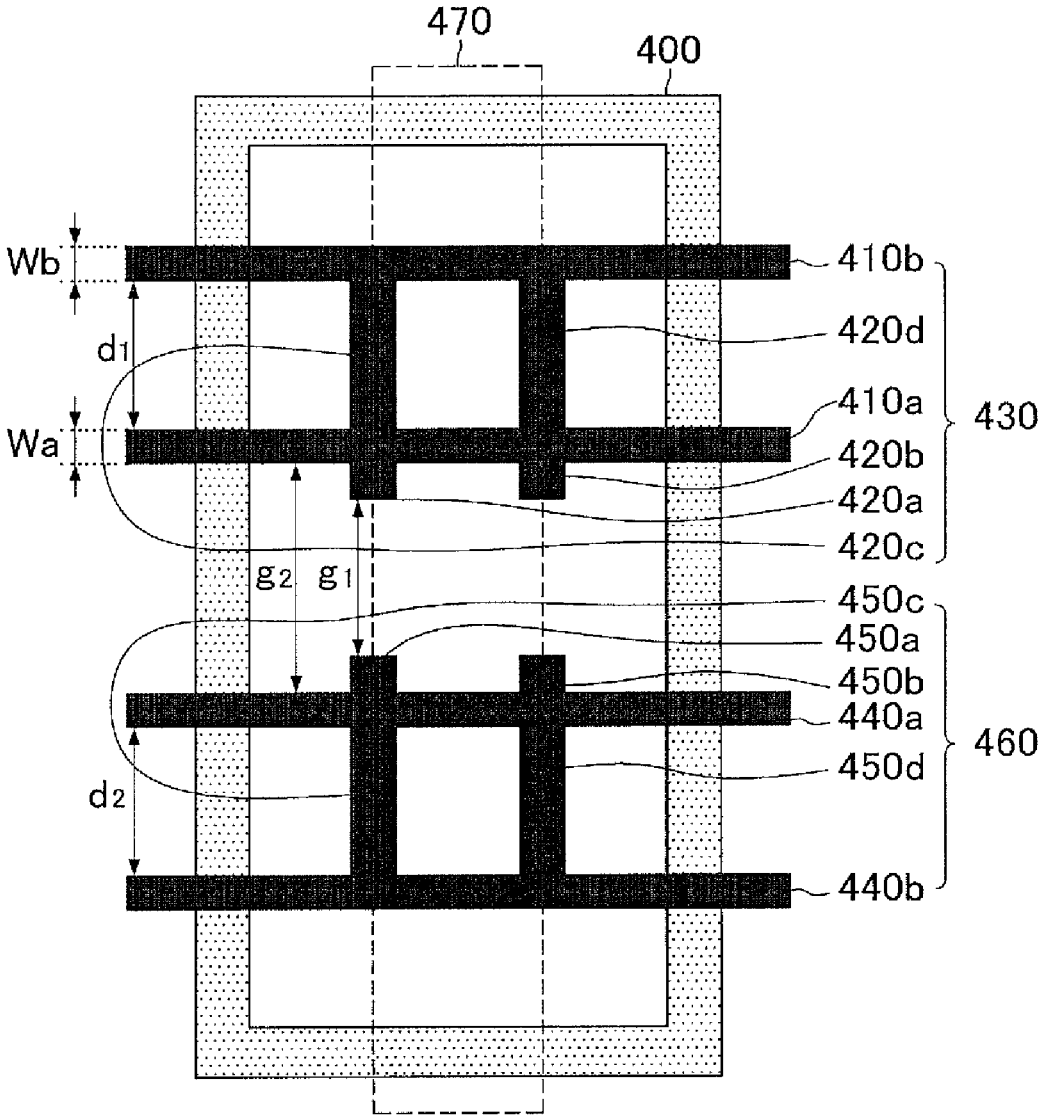
FIGS. 4A to 4E illustrate a first implementation associated with first and second electrodes of the plasma display panel according to the exemplary embodiment.

As illustrated in FIG. 4A, at least one of a first electrode 430 or a second electrode 460 may include at least one line portion intersecting a third electrode 370 inside a discharge cell partitioned by a barrier rib 400. For instance, the first electrode 430 includes first and second line portions 410*a* and 410*b*, and the second electrode 460 includes first and second line portions 440*a* and 440*b*.

The line portions 410*a*, 410*b*, 440*a* and 440*b* are spaced apart from one another with a predetermined distance therebetween. For instance, the first and second line portions 410*a* and 410*b* of the first electrode 430 are spaced apart from each other with a distance d1 therebetween. The first and second line portions 440*a* and 440*b* of the second electrode 1460 are spaced apart from each other with a distance d2 therebetween. The distance d1 may be equal to or different from the distance d2.

The line portions 410*a*, 410*b*, 440*a* and 440*b* each have a predetermined width. For instance, the first and second line portions 410*a* and 410*b* of the first electrode 430 have widths Wa and Wb, respectively. The width Wa may be equal to or different from the width Wb.

A shape of the first electrode 430 may be symmetrical or asymmetrical to a shape of the second electrode 460 inside the discharge cell. For instance, while the first electrode 430 may include three line portions, the second electrode 460 may include two line portions.

The number of line portions in the first and second electrodes 430 and 460 may vary. For instance, the first electrode 430 or the second electrode 460 may include 4 or 5 line portions.

At least one of the first electrode 430 or the second electrode 460 may include at least one projecting portion projecting from the line portion. For instance, the first electrode 430 includes two projecting portions 420*a* and 420*b* projecting from the line portion 410*a*, and the second electrode 460 includes two projecting portions 450*a* and 450*b* projecting from the line portion 440*a*.

The projecting portions 420*a*, 420*b*, 450*a* and 450*b* may project in a direction toward the center of the discharge cell inside the discharge cell.

The projecting portions 420*a* and 420*b* of the first electrode 430 may be positioned to face the projecting portions 450*a* and 450*b* of the second electrode 460. Hence, an interval g1 between the projecting portions 420*a* and 420*b* and the projecting portions 450*a* and 450*b* may be smaller than an interval g2 between the first line portion 410*a* of the first electrode 430 and the first line portion 440*a* of the second electrode 460.

When a driving signal is supplied to the first electrode 430 and the second electrode 460, a discharge firstly occurs between the projecting portions 420*a* and 420*b* of the first electrode 430 and the projecting portions 450*a* and 450*b* of the second electrode 460. Then, the discharge is diffused into the first and second line portions 410*a* and 410*b* of the first electrode 430 and the first and second line portions 440*a* and 440*b* of the second electrode 460.

At least one of the fist electrode 430 or the second electrode 460 includes at least one connecting portion connecting the two or more line portions. For instance, connecting portions 420*c* and 420*d* of the first electrode 430 connect the first and second line portions 410*a* and 410*b* to each other. Connecting portions 450*c* and 450*d* of the second electrode 460 connect the first and second line portions 440*a* and 440*b* to each other. The connecting portions 420*c*, 420*d*, 450*c* and 450*d* allow a discharge generated between the projecting portions 420*a*, 420*b*, 450*a* and 450*b* to be easily diffused into the rear of the discharge cell partitioned by the barrier rib 400.

At least one of the connecting portions 420*c*, 420*d*, 450*c* and 450*d* and at least one of the projecting portions 420*a*, 420*b*, 450*a* and 450*b* may overlap each other in a direction parallel to the third electrode 470. Preferably, at least one of the connecting portions 420*c*, 420*d*, 450*c* and 450*d* and at least one of the projecting portions 420*a*, 420*b*, 450*a* and 450*b* may be positioned in a straight line.

For instance, the connecting portion 420*c* and the projecting portion 420*a* of the first electrode 430 overlap each other in a direction parallel to the third electrode 470, and the connecting portion 420*d* and the projecting portion 420*b* of the first electrode 430 overlap each other in a direction parallel to the third electrode 470.

Figure 4B:
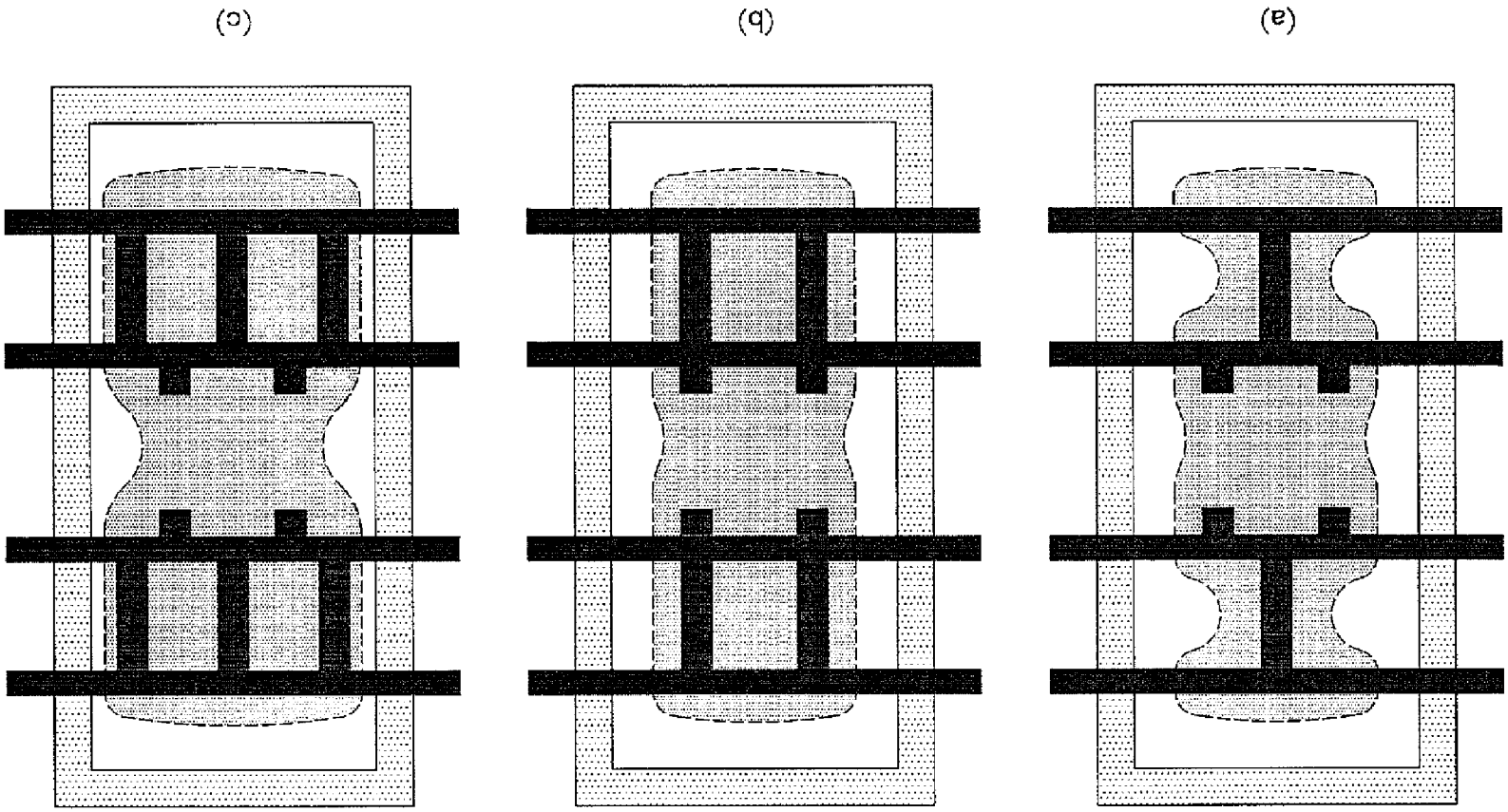

As illustrated in FIG. 4B, (a) illustrates a case where a projecting portion and a connecting portion are not positioned in a straight line. In FIG. 4B, an area defined by the dotted line indicates a light generation area of a phosphor layer. The fact that the light generation area is relatively wide means that a discharge is widely diffused. On the contrary, the fact that the light generation area is relatively narrow means that a discharge is not widely diffused.

In (a) of FIG. 4B, because a relatively narrow charge moving path is formed between first and second line portions and the projecting portion and the connecting portion are not positioned in a straight line, it is difficult to smoothly diffuse a discharge generated between the projecting portion of the first electrode and the projecting portion of the second electrode into the second portions of the first and second electrodes. Hence, the driving efficiency can be relatively low.

Similar to FIG. 4A, (b) of FIG. 4B illustrates a case where a projecting portion and a connecting portion are positioned in a straight line. In this case, because a discharge generated between the projecting portion of the first electrode and the projecting portion of the second electrode is sufficiently diffused into the second portions of the first and second electrodes through the connecting portion overlapping the projecting portion, the driving efficiency can be improved.

(c) of FIG. 4B illustrates another case where a projecting portion and a connecting portion are not positioned in a straight line. In (c) of FIG. 4B, the number of connecting potions is more than the number of projecting portion so as to sufficiently widen a charge moving path between first and second line portions. It is likely to sufficiently diffuse a discharge generated between the projecting portion of the first electrode and the projecting portion of the second electrode into the second portions of the first and second electrodes. However, because an aperture ratio is reduced due to the connecting portion, a luminance and the driving efficiency can be reduced.

Accordingly, it is preferable that the projecting portion and the connecting portion are positioned in a straight line.

Figure 4C:
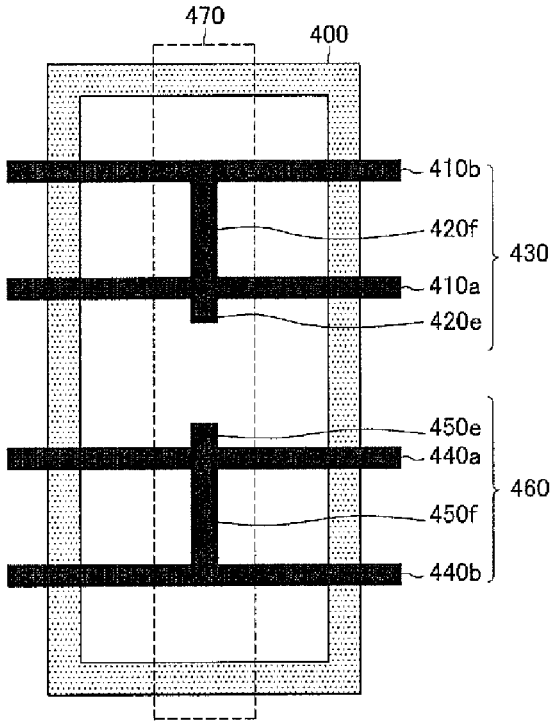

The number of projecting portions and the number of connecting portions of the first and second electrodes may be variously changed. For instance, as illustrated in FIG. 4C, each of the first and second electrodes 430 and 460 may include one projecting portion and one connecting portion. In other words, the first electrode 430 includes one projecting portion 420*e* and one connecting portion 420*f*, and the second electrode 460 includes one projecting portion 450*e* and one connecting portion 450*f*.

Figure 4D:
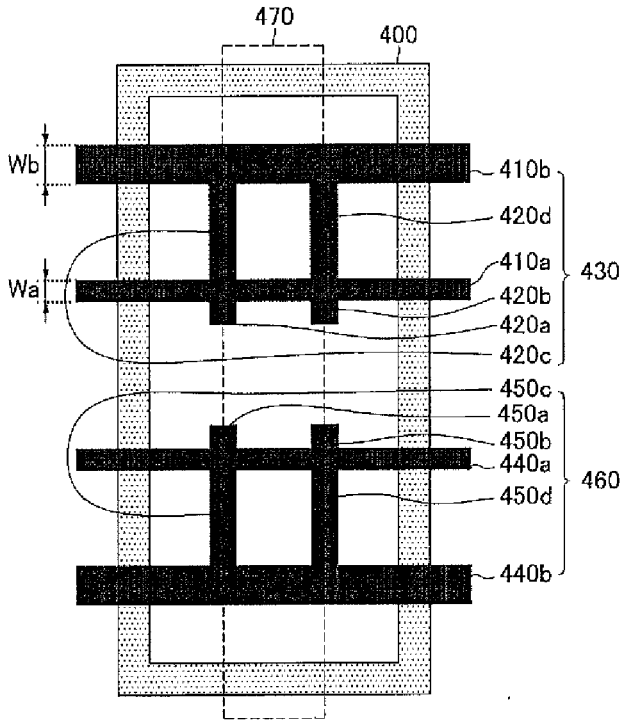

Further, a width of at least one of the plurality of line portions 410*a*, 410*b*, 440*a* and 440*b* may be different from widths of the other line portions. For instance, as illustrated in FIG. 4D, a width Wa of the first line portion 410*a* of the first electrode 430 may be smaller than a width Wb of the second line portion 410*b* of the first electrode 430.

Figure 4E:
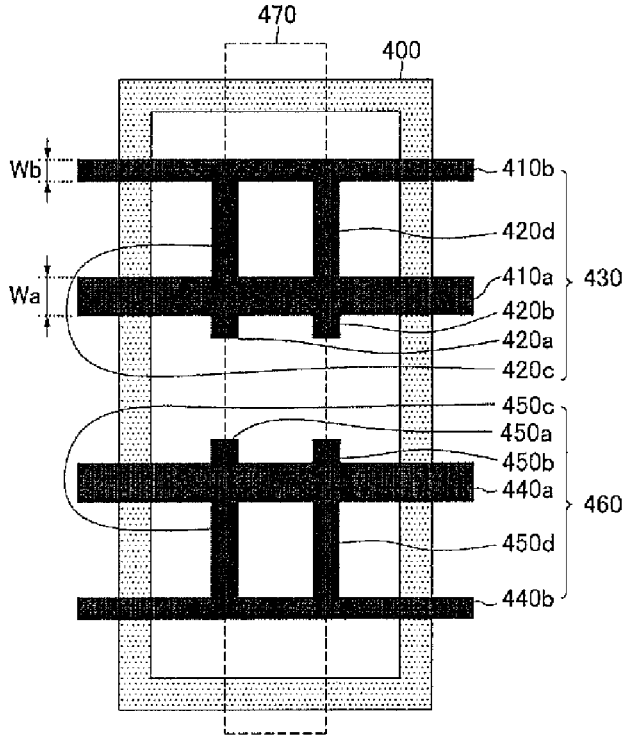

Further, as illustrated in FIG. 4E, a width Wa of the first line portion 410*a* may be larger than a width Wb of the second line portion 410*b*.

Figure 5:
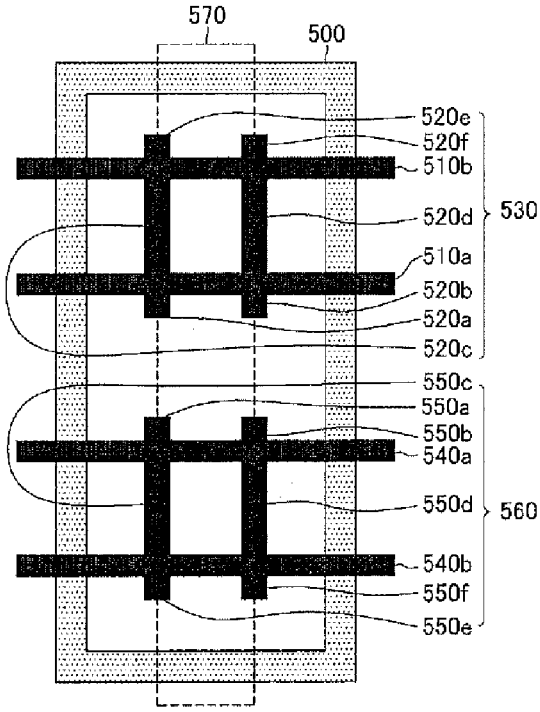
FIG. 5 illustrates a second implementation associated with first and second electrodes of the plasma display panel according to the exemplary embodiment.

FIG. 5 illustrates a second implementation associated with first and second electrodes of the plasma display panel according to the exemplary embodiment. The description of structures and components identical or equivalent to those illustrated and described in FIGS. 4A to 4E is briefly made or is entirely omitted in FIG. 5.

As illustrated in FIG. 5, a first electrode 430 includes projecting portions 520*a* and 520*b* and tail portions 520*e* and 520*f* projecting from line portions 510*a* and 510*b* in a direction opposite a projecting direction of the projecting portions 520*a* and 520*b*. A second electrode 560 includes projecting portions 550*a* and 550*b* and tail portions 550*e* and 550*f* projecting from line portions 540*a* and 540*b* in a direction opposite a projecting direction of the projecting portions 550*a* and 550*b*.

For instance, the projecting portions 520*a*, 520*b*, 550*a* and 550*b* may project from the first line portions 510*a* and 540*a* in a direction toward the center of a discharge cell partitioned by a barrier rib 500, and the tail portions 520*e*, 520*f*, 550*e* and 550*f* may project from the second line portions 510*b* and 540*b* in a direction opposite the projecting direction of the projecting portions 520*a*, 520*b*, 550*a* and 550*b*.

As above, because the first electrode 530 and the second electrode 560 each include the tail portions 520*e*, 520*f*, 550*e* and 550*f*, a discharge generated between the projecting portions 520*a*, 520*b*, 550*a* and 550*b* can be more widely diffused inside the discharge cell. Hence, a luminance and the driving efficiency can be improved.

The tail portions 520*e*, 520*f*, 550*e* and 550*f* may be positioned in a straight line with the projecting portions 520*a*, 520*b*, 550*a* and 550*b* and connecting portions 520*c*, 520*d*, 550*c* and 550*d*.

For instance, in FIG. 5, the projecting portion includes the first projecting portions 520*a* and 550*a* and the second projecting portions 520*b* and 550*b*; the tail portion includes the first tail portions 520*e* and 550*e* and the second tail portions 520*f* and 550*f* projecting in a direction opposite the projecting direction of the first projecting portions 520*a* and 550*a* and the second projecting portions 520*b* and 550*b*; and the connecting portion includes the first connecting portions 520*c* and 550*c* corresponding to the first projecting portions 520*a* and 550*a* and the first tail portions 520*e* and 550*e* and the second connecting portions 520*d* and 550*d* corresponding to the second projecting portions 520*b* and 550*b* and the second tail portions 520*f* and 550*f*. The first projecting portions 520*a* and 550*a*, the first connecting portions 520*c* and 550*c*, and the first tail portions 520*e* and 550*e* are positioned in a straight line, and the second projecting portions 520*b* and 550*b*, the second connecting portions 520*d* and 550*d*, and the second tail portions 520*f* and 550*f* are positioned in a straight line.

In the panel structure of FIG. 5, a discharge generated between the projecting portions 520*a*, 520*b*, 550*a* and 550*b* can be more widely diffused inside the discharge cell along the connecting portions 520*c*, 520*d*, 550*c* and 550*d* and the tail portions 520*e*, 520*f*, 550*e* and 550*f*.

Figure 6A:
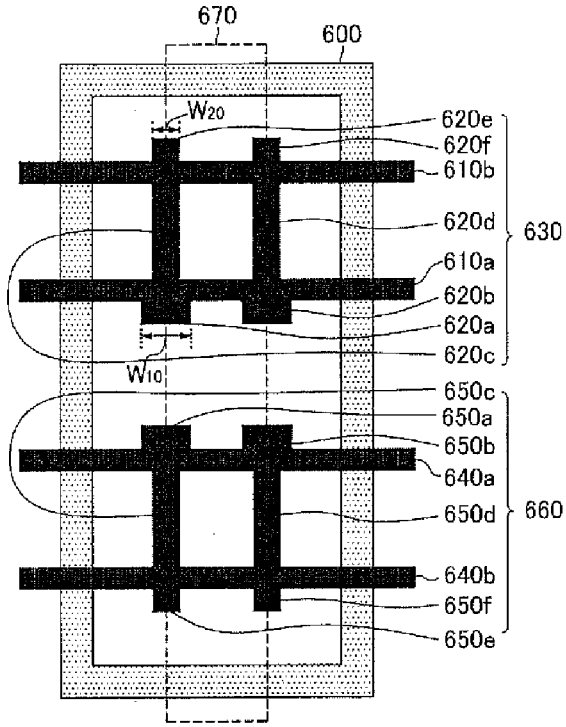
FIGS. 6A and 6B illustrate a third implementation associated with first and second electrodes of the plasma display panel according to the exemplary embodiment.
Figure 6B:
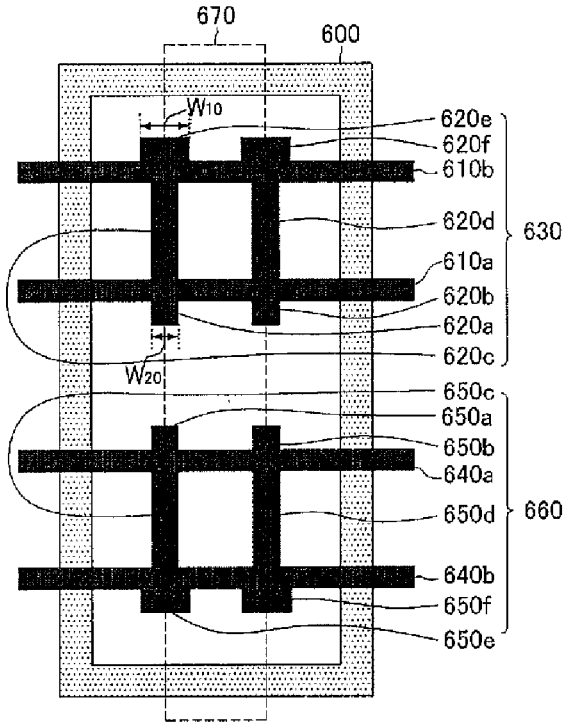

FIGS. 6A and 6B illustrate a third implementation associated with first and second electrodes of the plasma display panel according to the exemplary embodiment. The description of structures and components identical or equivalent to those illustrated and described in FIGS. 4A to 4E is briefly made or is entirely omitted in FIGS. 6A and 6B.

As illustrated in FIG. 6A, a shape of projecting portions 620*a*, 620*b*, 650*a* and 650*b* may be different from a shape of tail portions 620*e*, 620*f*, 650*e* and 650*f*.

For instance, a width of the projecting portions 620*a*, 620*b*, 650*a* and 650*b* may be set to a width W10, and a width of the tail portions 620*e*, 620*f*, 650*e* and 650*f* may be set to a width W20 smaller than the width W10.

As above, when the width W10 of the projecting portions 620*a*, 620*b*, 650*a* and 650*b* is larger than the width W20 of the tail portions 620*e*, 620*f*, 650*e* and 650*f*, a firing voltage of a discharge generated between a first electrode 630 and a second electrode 660 can be lowered.

As illustrated in FIG. 6B, a width of the projecting portions 620*a*, 620*b*, 650*a* and 650*b* may be set to a width W20, and a width of the tail portions 620*e*, 620*f*, 650*e* and 650*f* may be set to a width W10 larger than the width W20.

As above, when the width W20 of the projecting portions 620*a*, 620*b*, 650*a* and 650*b* is smaller than the width W10 of the tail portions 620*e*, 620*f*, 650*e* and 650*f*, a discharge generated inside the discharge cell can be more widely diffused into the rear of the discharge cell.

Figure 7A:
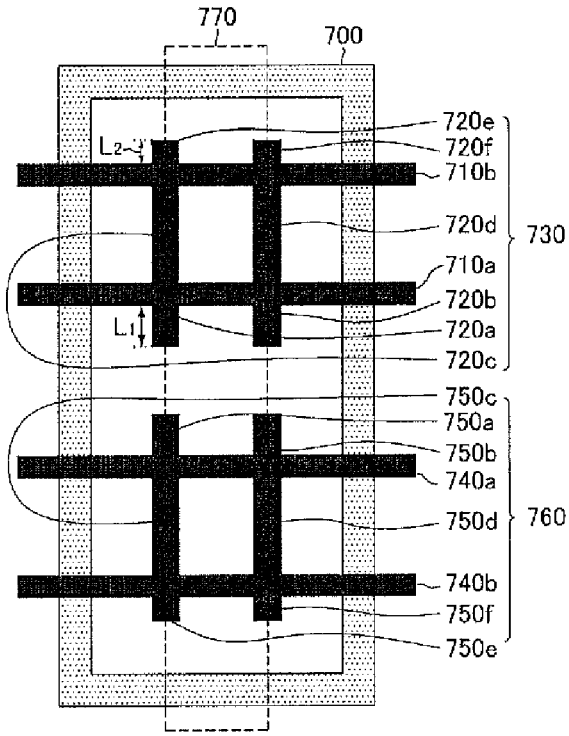
FIGS. 7A and 7B illustrate a fourth implementation associated with first and second electrodes of the plasma display panel according to the exemplary embodiment.
Figure 7B:
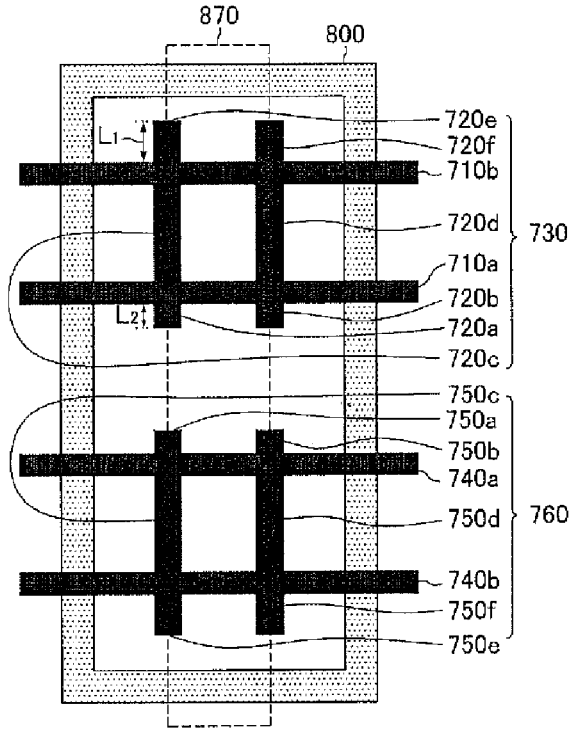

FIGS. 7A and 7B illustrate a fourth implementation associated with first and second electrodes of the plasma display panel according to the exemplary embodiment. The description of structures and components identical or equivalent to those illustrated and described in FIGS. 4A to 4E is briefly made or is entirely omitted in FIGS. 7A and 7B.

As illustrated in FIG. 7A, a length of projecting portions 720*a*, 720*b*, 750*a* and 750*b* may be different from a length of tail portions 720*e*, 720*f*, 750*e* and 750*f*.

For instance, a length of the projecting portions 720*a*, 720*b*, 750*a* and 750*b* may be set to a length L1, and a length of the tail portions 720*e*, 720*f*, 750*e* and 750*f* may be set to a length L2 shorter than the length L1.

As above, when the length L1 of the projecting portions 720*a*, 720*b*, 750*a* and 750*b* is longer than the length L2 of the tail portions 720*e*, 720*f*, 750*e* and 750*f*, a firing voltage of a discharge generated between a first electrode 730 and a second electrode 760 can be lowered.

As illustrated in FIG. 7B, a length of the projecting portions 720*a*, 720*b*, 750*a* and 750*b* may be set to a length L2, and a length of the tail portions 720*e*, 720*f*, 750*e* and 750*f* may be set to a length L1 longer than the length L2.

As above, when the length L2 of the projecting portions 720*a*, 720*b*, 750*a* and 750*b* is shorter than the length L1 of the tail portions 720*e*, 720*f*, 750*e* and 750*f*, a discharge generated inside the discharge cell can be more efficiently diffused into the rear of the discharge cell.

Considering that light is mainly generated in an discharge diffusing area inside the discharge cell, the length L1 of the tail portions 720*e*, 720*f*, 750*e* and 750*f* may be longer than the length L2 of the projecting portions 720*a*, 720*b*, 750*a* and 750*b* so as to improve a luminance of an image.

Figure 8:
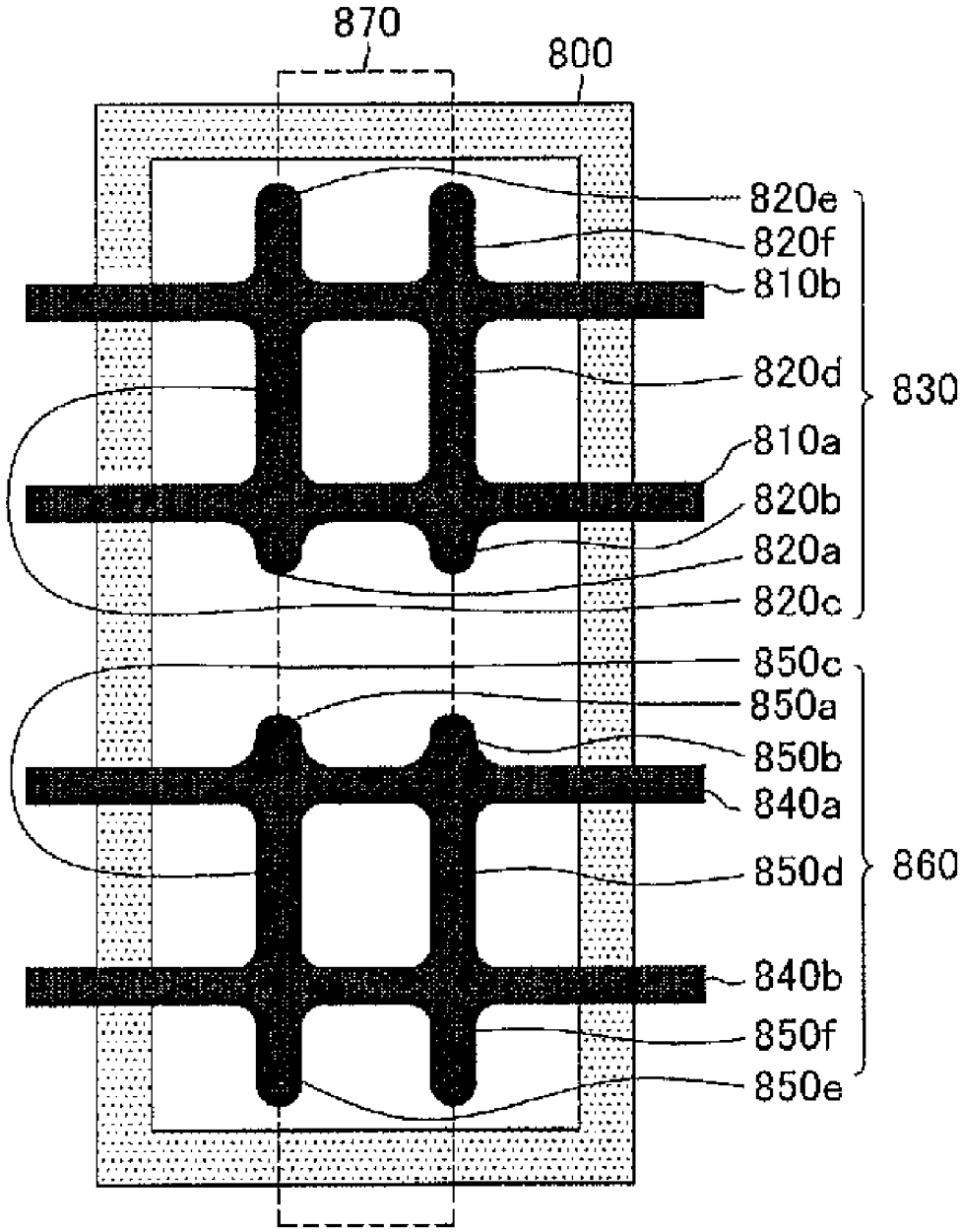
FIG. 8 illustrates a fifth implementation associated with first and second electrodes of the plasma display panel according to the exemplary embodiment.

FIG. 8 illustrates a fifth implementation associated with first and second electrodes of the plasma display panel according to the exemplary embodiment. The description of structures and components identical or equivalent to those illustrated and described in FIGS. 4A to 4E is briefly made or is entirely omitted in FIG. 8.

As illustrated in FIG. 8, projecting portions 820*a*, 820*b*, 850*a* and 850*b* may include a portion with the curvature. Tail portions 820*e*, 820*f*, 850*e* and 850*f* may include a portion with the curvature.

A portion where the projecting portions 820*a*, 820*b*, 850*a* and 850*b* are adjacent to line portions 810*a*, 810*b*, 840*a* and 840*b* may include the curvature. Further, a portion where the line portions 810*a*, 810*b*, 840*a* and 840*b* are adjacent to connecting portions 820*c*, 820*d*, 850*c* and 1850*c* may include the curvature.

In the panel structure of FIG. 8, a first electrode 830 and a second electrode 860 can be easily manufactured. Further, the portion with the curvature prevents wall charges from being excessively accumulated on a specific portion during a driving of the panel, and thus a driving stability can be improved.

Figure 9A:
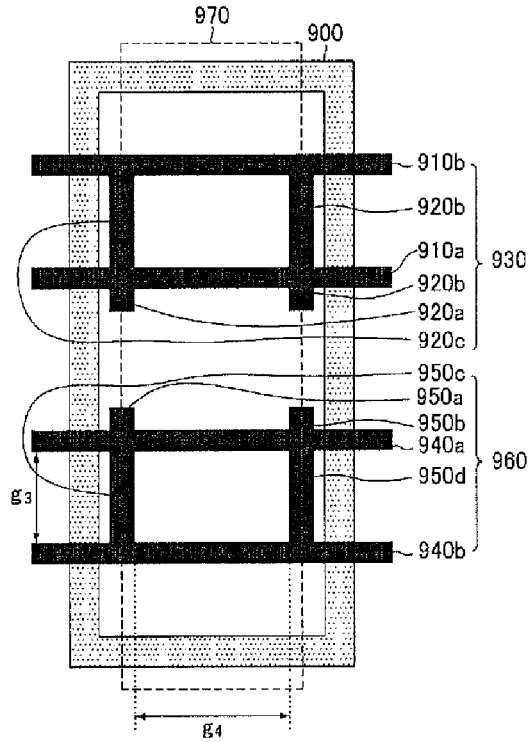
FIGS. 9A to 9C are diagrams for explaining an interval between line portions and an interval between connecting portions.
Figure 9B:
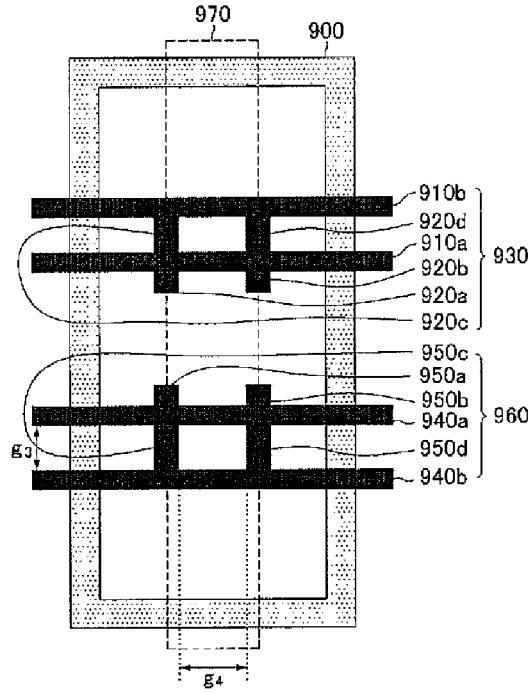
Figure 9C:
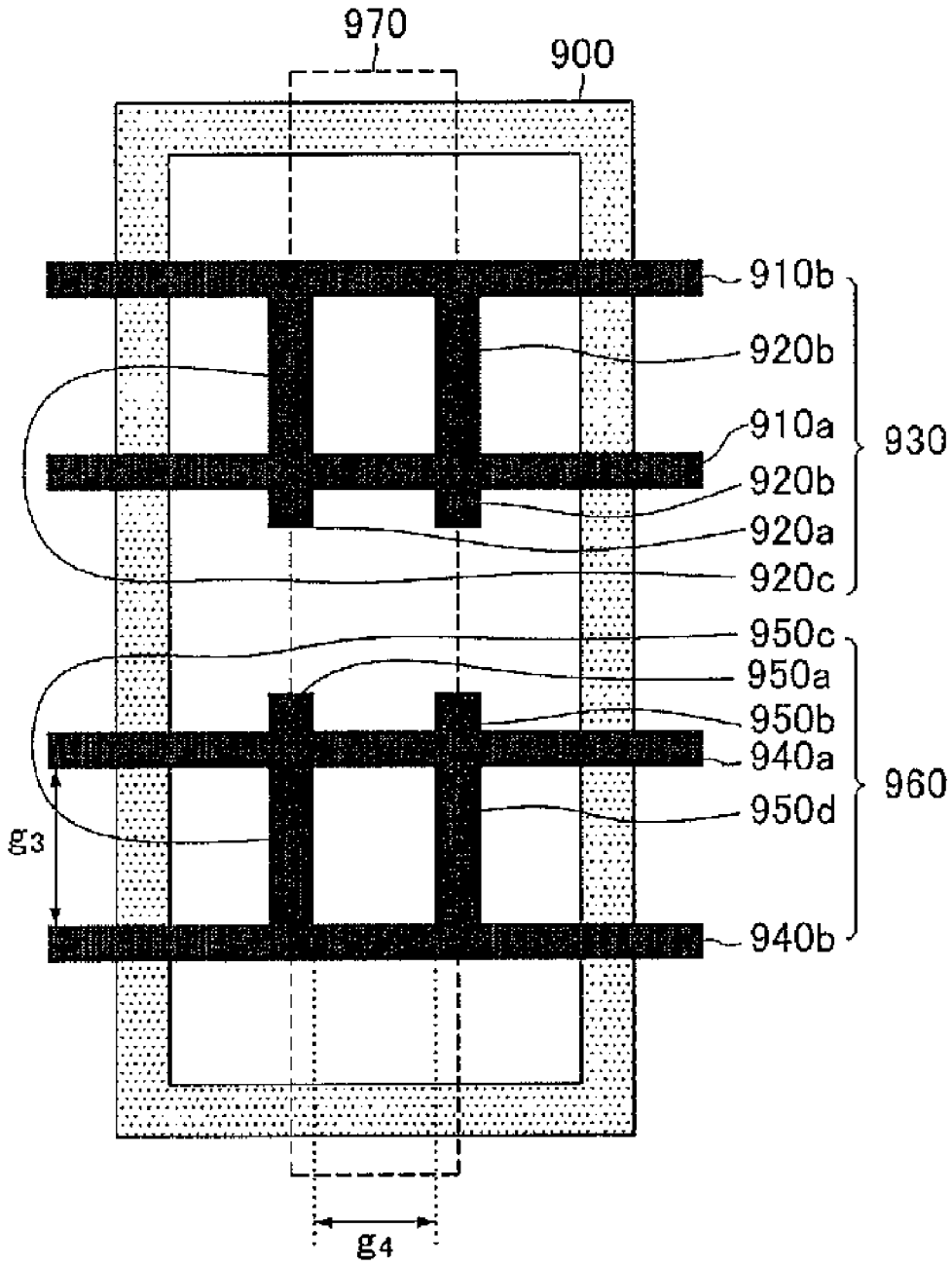

FIGS. 9A to 9C are diagrams for explaining an interval between line portions and an interval between connecting portions.

FIGS. 9A and 9B illustrate a case where an interval g3 between two successively positioned line portions 910*a* and 910*b* or 940*a* and 940*b* among a plurality of line portions is shorter than an interval g4 between two successively positioned connecting portions 920*c* and 920*d* or 950*c* and 950*d* among a plurality of connecting portions.

In FIG. 9A, it seems to increase the interval g4 between the two successively positioned connecting portions 920*c* and 920*d* or 950*c* and 950*d* in a state where the interval g3 between the two successively positioned line portions 910*a* and 910*b* or 940*a* and 940*b* is maintained. In FIG. 9B, it seems to reduce the interval g3 between the two successively positioned line portions 910*a* and 910*b* or 940*a* and 940*b* in a state where the interval g4 between the two successively positioned connecting portions 920*c* and 920*d* or 950*c* and 950*d* is maintained.

In FIG. 9A, a discharge generated between projecting portions 920*a*, 920*b*, 950*a* and 950*b* of first and second electrodes 930 and 960 can be widely diffused. However, because the interval g4 is excessively large, the discharge intensity can be excessively reduced in a middle portion of the discharge cell. Hence, a luminance can be reduced.

In FIG. 9B, a sufficiently strong discharge can occur in the middle portion of the discharge cell. However, a discharge generated between the projecting portions 920*a*, 920*b*, 950*a* and 950*b* of the first and second electrodes 930 and 960 cannot be sufficiently diffused into the rear of the discharge cell. Hence, a luminance can be reduced.

On the contrary, in FIG. 9C, an interval g3 between the two successively positioned line portions 910*a* and 910*b* or 940*a* and 940*b* is longer than an interval g4 between the two successively positioned connecting portions 920*c* and 920*d* or 950*c* and 950*d*. In the panel structure of FIG. 9C, a sufficiently strong discharge can occur in the middle portion of the discharge cell, and a discharge generated between the projecting portions 920*a*, 920*b*, 950*a* and 950*b* of the first and second electrodes 930 and 960 can be widely diffused into the rear of the discharge cell. Hence, a luminance and the driving efficiency can be improved.

Figure 10:
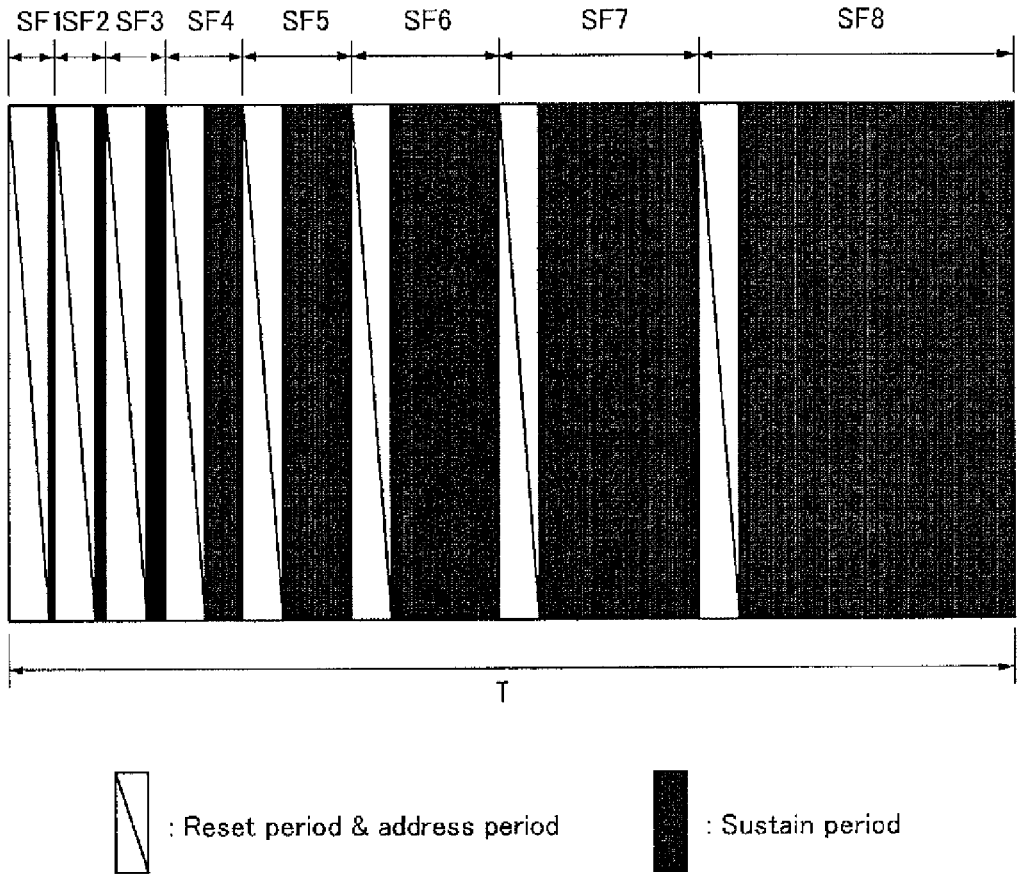
FIG. 10 illustrates a frame for achieving a gray scale of an image in the plasma display panel according to the exemplary embodiment.

FIG. 10 illustrates a frame for achieving a gray scale of an image in the plasma display panel according to the exemplary embodiment.

Figure 11:
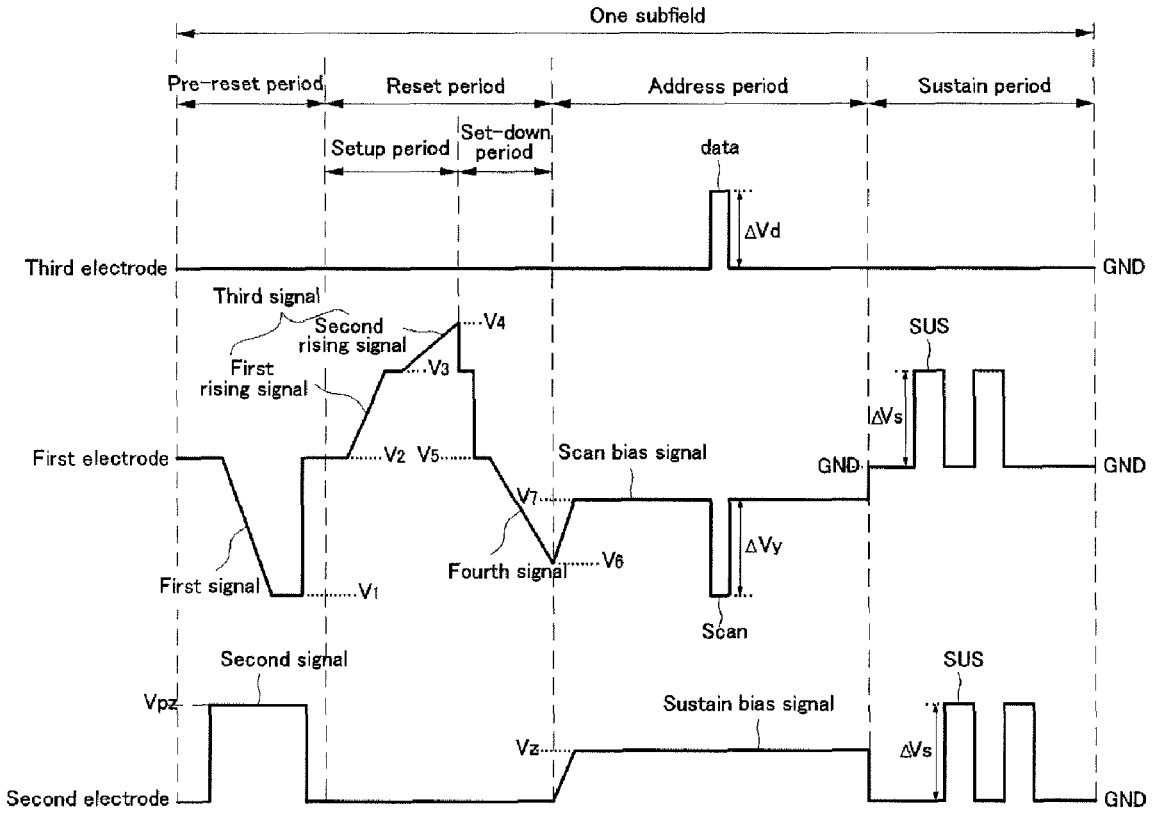
FIG. 11 illustrates an example of an operation of the plasma display panel according to the exemplary embodiment.

FIG. 11 illustrates an example of an operation of the plasma display panel according to the exemplary embodiment.

As illustrated in FIG. 10, a frame for achieving a gray scale of an image in the plasma display panel according to the exemplary embodiment is divided into several subfields each having a different number of emission times.

Each subfield is subdivided into a reset period for initializing all the cells, an address period for selecting cells to be discharged, and a sustain period for representing gray level in accordance with the number of discharges.

For instance, if an image with 256-level gray scale is to be displayed, a frame, as illustrated in FIG. 10, is divided into 8 subfields SF1 to SF8. Each of the 8 subfields SF1 to SF8 is subdivided into a reset period, an address period, and a sustain period.

The number of sustain signals supplied during the sustain period determines gray level weight in each of the subfields. For instance, in such a method of setting gray level weight of a first subfield to $2^0$ and gray level weight of a second subfield to $2^1$, the sustain period increases in a ratio of $2^n$ (where, n=0, 1, 2, 3, 4, 5, 6, 7) in each of the subfields. Since the sustain period varies from one subfield to the next subfield, a specific gray level is achieved by controlling the sustain period which are to be used for discharging each of the selected cells, i.e., the number of sustain discharges that are realized in each of the discharge cells.

The plasma display panel according to the exemplary embodiment uses a plurality of frames to display an image for 1 second. For instance, 60 frames are used to display an image 1 second. In this case, a time width T of one frame may be 1/60 seconds, i.e., 16.67 ms.

In FIG. 10, one frame includes 8 subfields. However, the number of subfields constituting one frame may vary. For instance, one frame may include 12 or 10 subfields.

Further, in FIG. 10, the subfields are arranged in increasing order of gray level weight. However, he subfields may be arranged in decreasing order of gray level weight, or the subfields may be arranged regardless of gray level weight.

FIG. 11 illustrates an example of an operation of the plasma display panel according to the exemplary embodiment in one subfield of a plurality of subfields of one frame as illustrated in FIG. 10.

During a pre-reset period prior to a reset period, a first signal with a gradually falling voltage is supplied to a first electrode Y. A second signal corresponding to the first signal is supplied to a second electrode Z. A polarity direction of the second signal is opposite to a polarity direction of the first signal. The second signal is constantly maintained at a voltage Vpz. The voltage Vpz may be substantially equal to a voltage (i.e., a sustain voltage Vs) of a sustain signal (SUS) to be supplied during a sustain period.

As above, when the first signal is supplied to the first electrode Y and the second signal is supplied to the second electrode Z during the pre-reset period, wall charges of a predetermined polarity are accumulated on the first electrode Y, and wall charges of a polarity opposite the polarity of the wall charges accumulated on the first electrode Y are accumulated on the second electrode Z. For instance, wall charges of a positive polarity are accumulated on the first electrode Y, and wall charges of a negative polarity are accumulated on the second electrode Z.

During a reset period, a third signal is supplied to the first electrode Y. The third signal includes a first rising signal and a second rising signal. The first rising signal gradually rises from a second voltage V2 to a third voltage V3 with a first slope, and the second rising signal gradually rises from the third voltage V3 to a fourth voltage V4 with a second slope.

The third signal generates a weak dark discharge (i.e., a setup discharge) inside the discharge cell during a setup period of the reset period, thereby accumulating a proper amount of wall charges inside the discharge cell.

The setup discharge does not occur at a voltage equal to or less than the third voltage V3, and the setup discharge can occur at a voltage equal to or more than the third voltage V3. Therefore, a voltage of the first electrode Y rapidly rises up to the third voltage V3 and then lowly rises. Hence, an excessive increase in a time width of the setup period can be prevented, and a stability of the setup discharge can be improved. Considering this, it is preferable that the second slope is gentler than the first slope.

Wall charges accumulated inside the discharge cells during the pre-reset period can assist the setup discharge generated during the setup period. Accordingly, although a voltage of the third signal is lowered, the stable setup discharge can occur. When the voltage of the third signal is lowered, the intensity of the setup discharge can be reduced and a reduction in the contrast characteristic can be prevented.

As explained in FIG. 2, a case where the first electrode and the second electrode each have the single-layered structure has a lower aperture ratio than a case where the first electrode and the second electrode each have the multi-layered structure, and thus a contrast characteristic can be reduced.

On the contrary, the operation during the pre-reset period prior to the reset period can prevent a reduction in the contrast characteristic even if the first electrode and the second electrode each have the single-layered structure.

A subfield, which is first arranged in time order in a plurality of subfields of one frame, may include a pre-reset period prior to a reset period so as to obtain sufficient driving time. Or, two or three subfields may include a pre-reset period prior to a reset period.

During a set-down period of the reset period, a fourth signal of a polarity direction opposite a polarity direction of the third signal is supplied to the first electrode Y. The fourth signal gradually falls from a fifth voltage V5 lower than a peak voltage (i.e., the fourth voltage V4) of the third signal to a sixth voltage V6. The fourth signal generates a weak erase discharge (i.e., a set-down discharge) inside the discharge cell. Furthermore, the remaining wall charges are uniform inside the discharge cells to the extent that an address discharge can be stably performed.

During an address period, a scan bias signal, which is maintained at a seventh voltage V7 higher than a lowest voltage (i.e., the sixth voltage V6) of the fourth signal, is supplied to the first electrode Y.

A scan signal (Scan), which falls from the scan bias signal by a scan voltage magnitude ΔVy, is supplied to the first electrode Y.

The width of the scan signal may vary from one subfield to the next subfield. For instance, the width of a scan signal in a subfield may be larger than the width of a scan signal in the next subfield in time order. Further, the width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, 1.9 μs, 1.9 μs, etc.

As above, when the scan signal (Scan) is supplied to the first electrode Y, a data signal (data) corresponding to the scan signal (Scan) is supplied to the third electrode X. The data signal (data) rises from a ground level voltage GND by a data voltage magnitude ΔVd.

As the voltage difference between the scan signal (Scan) and the data signal (data) is added to the wall voltage generated during the reset period, an address discharge is generated within the discharge cell to which the data signal (data) is supplied.

A sustain bias signal is supplied to the second electrode Z during the address period to prevent the generation of the unstable address discharge by interference of the second electrode Z. The sustain bias signal is substantially maintained at a sustain bias voltage Vz which is lower than the sustain voltage Vs and higher than the ground level voltage GND.

During the sustain period, a sustain signal (SUS) is alternately supplied to the first electrode Y and the second electrode Z. As the wall voltage within the discharge cell selected by performing the address discharge is added to the sustain voltage Vs of the sustain signal (SUS), every time the sustain signal (SUS) is supplied, a sustain discharge, i.e., a display discharge occurs between the first electrode Y and the second electrode Z. Accordingly, a predetermined image is displayed on the plasma display panel.

A plurality of sustain signals are supplied during a sustain period of at least one subfield, and a width of at least one of the plurality of sustain signals may be different from widths of the other sustain signals. For instance, a width of the first supplied sustain signal among the plurality of sustain signals may be larger than widths of the other sustain signals. Hence, a sustain discharge can more stably occur.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate on which a first electrode and a second electrode are positioned parallel to each other;

a rear substrate on which a third electrode is positioned to intersect the first electrode and the second electrode; and a barrier rib positioned between the front substrate and the rear substrate to partition a discharge cell, wherein:

the first electrode and the second electrode are bus electrodes, the first electrode and the second electrode each include a first line portion and a second line portion intersecting the third electrode, a projecting portion projecting from the first line portion, and a connecting portion connecting the first line portion and the second line portion, the first electrode and the second electrode each further include a tail portion that projects from the second line portion, the projecting portion includes first and second projecting portions projecting in a direction toward the center of the discharge cell, the tail portion includes first and second tail portions projecting in a direction opposite a projecting direction of the first and second projecting portions, the connecting portion includes a first connecting portion positioned in a straight line with the first projecting portion and the first tail portion and a second connecting portion positioned in a straight line with the second projecting portion and the second tail portion, and a size of a portion of widths of the first and second projecting portions or the first and second tail portions is greater than a size of the widths of the first and second connecting portions.

2. The plasma display panel of claim 1, wherein a length of the projecting portion is different from a length of the tail portion.

3. The plasma display panel of claim 1, wherein at least one of the projecting portion or the tail portion includes a portion with curvature.

4. The plasma display panel of claim 1, wherein the number of projecting portions is equal to the number of connecting portions.

5. A plasma display panel comprising:

a front substrate on which a first electrode and a second electrode are positioned parallel to each other;

a rear substrate on which a third electrode is positioned to intersect the first electrode and the second electrode; and a barrier rib positioned between the front substrate to partition a discharge cell, wherein:

the first electrode and the second electrode are bus electrodes, the first electrode and the second electrode each include a plurality of line portions intersecting the third electrode, a plurality of projecting portions projecting from a line portion of the plurality of line portions, and a plurality of connecting portions connecting at least two line portions of the plurality of line portions to each other, each of the plurality of projecting portions includes first and second successively positioned projecting portions projecting in a direction toward the center of the discharge cell, each of the plurality of connecting portions includes a first connecting portion positioned in a straight line with the first projecting portion and a second connecting portion positioned in a straight line with the second projecting portion, an interval between two successively positioned line portions of the plurality of line portions is larger than an interval between the first connecting portion and the second connecting portion, and a size of a portion of widths of the first and second projecting portions or the first and second tail portions is greater than a size of the widths of the first and second connecting portions.

6. The plasma display panel of claim 5, further comprising a plurality of tail portions that each project in a direction opposite a projecting direction of the plurality of projecting portions.

7. The plasma display panel of claim 6, wherein each of the plurality of tail portions is positioned in a straight line with a respective one of the plurality of projecting portions and a respective one of the connecting portions.

8. The plasma display panel of claim 6, wherein each of the plurality of tail portions includes first and second tail portions projecting in a direction opposite a projecting direction of the first and second projecting portions of a respective one of the plurality of projecting portions, and the first connecting portion of a respective one of the plurality of connecting portions is positioned in a straight line with the first projecting portion of the respective one of the plurality of projecting portions and the first tail portion and the second connecting portion of the respective one of the plurality of connecting portions is positioned in a straight line with the second projecting portion of the respective one of the plurality of projecting portions and the second tail portion.

9. A plasma display panel comprising:

a front substrate on which a first electrode and a second electrode are positioned parallel to each other;

a rear substrate on which a third electrode is positioned to intersect the first electrode and the second electrode; and a barrier rib positioned between the front substrate and the rear substrate to partition a discharge cell, wherein:

the first electrode and the second electrode are bus electrodes, the first electrode and the second electrode each include a plurality of line portions intersecting the third electrode, a projecting portion projecting from a line portion of the plurality of line portions, and a connecting portion connecting at least two line portions of the plurality of line portions to each other, the projecting portion includes first and second projecting portions projecting in a direction toward the center of the discharge cell, the connecting portion includes a first connecting portion positioned in a straight line with the first projecting portion and a second connecting portion positioned in a straight line with the second projecting portion, an interval between two successively positioned line portions of the plurality of line portions is larger than an interval between the first connecting portion and the second connecting portion, a size of a portion of widths of the first and second projecting portions or the first and second tail portions is greater than a size of the widths of the first and second connecting portions, the plasma display panel is configured to supply a first signal with a gradually falling voltage to the first electrode and supply a second signal of a polarity direction opposite a polarity direction of the first signal to the second electrode during a pre-reset period prior to a reset period of at least one subfield of a frame, and after the plasma display panel supplies the first signal, the plasma display panel is configured to supply a third signal with a gradually rising voltage to the first electrode, the third signal including a first rising signal whose voltage gradually rises with a first slope and a second rising signal whose a voltage gradually rises with a second slope.

10. The plasma display panel of claim 9, wherein a magnitude of a voltage of the second signal is substantially equal to a magnitude of a voltage of a sustain signal supplied to at least one of the first electrode or the second electrode during a sustain period after the reset period.

11. The plasma display panel of claim 9, wherein the second slope is gentler than the first slope.

12. The plasma display panel of claim 9, further comprising a tail portion that projects in a direction opposite a projecting direction of the projecting portion, wherein:

the tail portion includes first and second tail portions projecting in a direction opposite a projecting direction of the first and second projecting portions, and the first connecting portion is positioned in a straight line with the first projecting portion and the first tail portion and the second connecting portion is positioned in a straight line with the second projecting portion and the second tail portion.

13. A plasma display panel comprising:

a front substrate on which a first electrode and a second electrode are positioned parallel to each other;

a rear substrate on which a third electrode is positioned to intersect the first electrode and the second electrode; and a barrier rib positioned between the front substrate and the rear substrate to partition a discharge cell, wherein:

the first electrode and the second electrode are bus electrodes, the first electrode and the second electrode each include a first line portion and a second line portion intersecting the third electrode, a projecting portion projecting from the first line portion in a direction toward the center of the discharge cell, a connecting portion connecting the first line portion and the second line portion, and a tail portion projecting from the second line portion in a direction opposite a projecting direction of the projecting portions, the connecting portion is positioned in a straight line with the projecting portion and the tail portion, and a size of a portion of widths of the projecting portion or the tail portion is greater than a size of the widths of the connecting portion.

* * * * *